US009919228B2

(12) United States Patent
Ortel

(10) Patent No.: US 9,919,228 B2
(45) Date of Patent: Mar. 20, 2018

(54) TRACK SECTION FOR A RIDE, METHOD FOR TRAVELING OVER A TRACK SECTION, AND RIDE

(71) Applicant: Maurer Sohne GMBH & Co. KG, Munich (DE)

(72) Inventor: Thorsten Ortel, Munich (DE)

(73) Assignee: MACK RIDES GMBH & CO. KG (DE)

( * ) Notice: Subject to any disclaimer, the term of this patent is extended or adjusted under 35 U.S.C. 154(b) by 459 days.

(21) Appl. No.: 14/555,627

(22) Filed: Nov. 27, 2014

(65) Prior Publication Data

US 2015/0202536 A1 Jul. 23, 2015

Related U.S. Application Data

(63) Continuation of application No. PCT/EP2013/060211, filed on May 17, 2013.

(30) Foreign Application Priority Data

May 30, 2012 (DE) ..... 10 2012 104 687

(51) Int. Cl.
*A63G 21/04* (2006.01)
*A63G 7/00* (2006.01)

(52) U.S. Cl.
CPC ..... *A63G 21/04* (2013.01); *A63G 7/00* (2013.01)

(58) Field of Classification Search
CPC ..... A63G 7/00; A63G 21/04
See application file for complete search history.

(56) References Cited

U.S. PATENT DOCUMENTS 5,433,153 A 7/1995 Yamada
5,437,422 A * 8/1995 Newman ..... B61L 27/0038 246/182 R (Continued)

FOREIGN PATENT DOCUMENTS

DE 21 2006 000 027 U1 11/2007
DE 20 2009 001 966 U1 6/2009

(Continued)

OTHER PUBLICATIONS

The First Office Action issued in corresponding German Patent Application No. 2012104687, dated Nov. 9, 2012.

(Continued)

*Primary Examiner* — Zachary L Kuhfuss
(74) *Attorney, Agent, or Firm* — Day Pitney LLP

(57) ABSTRACT

A track section for a ride having a vehicle, divided into a first block segment and a second block segment. The first block segment has a first high point and ends at a second high point. The second block segment begins at the second high point. A first linear drive is situated before the first high point, and a second linear drive is situated between the first high point and the second high point. The positions of the high points relative to one another and the design of the linear drives are coordinated so the vehicle can be brought to a standstill in the first block segment if entry into the second block segment is not enabled. A method for traveling over the track section is provided, wherein a change in direction of travel of the vehicle is produced if the second block segment is not enabled for entry.

15 Claims, 2 Drawing Sheets

(56) References Cited

U.S. PATENT DOCUMENTS

| | | | | |
|---|---|---|---|---|
| 5,463,962 | A | 11/1995 | Gnezdilov | |
| 6,060,847 | A | 5/2000 | Hettema et al. | |
| 2011/0061558 | A1* | 3/2011 | Crawford ..... | A63G 7/00<br>104/53 |

FOREIGN PATENT DOCUMENTS

| | | | |
|---|---|---|---|
| DE | 10 2008 042 890 | A1 | 4/2010 |
| EP | 2 295 123 | A1 | 3/2011 |
| GB | 2 109 252 | A | 6/1983 |

OTHER PUBLICATIONS

International Preliminary Report on Patentability in corresponding PCT Application No. PCT/EP2013/060211, dated Dec. 2, 2014. (with English translation).

International Search Report in corresponding PCT Application No. PCT/EP2013/060211, dated Dec. 2, 2014. (with English translation).

* cited by examiner

TRACK SECTION FOR A RIDE, METHOD FOR TRAVELING OVER A TRACK SECTION, AND RIDE

RELATED APPLICATIONS

This application claims priority to, and is a continuation of, PCT Application No. PCT/EP2013/060211, filed May 17, 2013, which itself claims priority to German Application No. 102012104687.5, filed May 30, 2012, the teachings and disclosures of which are incorporated herein by reference.

BACKGROUND OF THE DISCLOSURE

The present invention relates to a track section, having at least one track, for a ride having at least one rail-borne vehicle, the track section being divided into a first and a second block segment. The invention further relates to a ride having least one track section of this type, and a method for traveling over such a track section.

A ride is typically understood to mean an apparatus which is used for targeted entertainment by moving passengers who are on the ride. Rides are therefore primarily employed at fairs, folk festivals, and in amusement parks and the like. However, the present invention relates only to a ride having at least one rail-borne vehicle, i.e., a roller coaster, looping coaster, whitewater course, or the like. A vehicle is to be understood here as a single vehicle or a roller coaster train.

To increase the appeal for the passengers, for customarily different track sections, these types of rides have special track elements in their track course. These track elements provide for variations for the passengers in a particular manner, for example by increased acceleration, upside-down travel, jerking changes in travel conditions, etc., and may be, for example, ascending slopes, steep drops, spirals, loops, "camel backs," water baths, or the like.

The vehicles traveling on the track generally do not have their own drive, and instead are accelerated by various drives which are integrated into the track course. In particular when ascending slopes are to be overcome, drives are mounted in the track prior to the ascending slopes. It has proven advantageous to provide linear drives. These may in particular be linear motors, i.e., linear synchronous motors (LSMs), linear induction motors (LIMs), or linear asynchronous motors, as well as friction wheels or the like. So-called launch drives, i.e., drives which allow a particularly high acceleration power, are particularly suited as linear drives, so that the passengers have an appealing ride experience. However, drives which are able to develop not only drive power, but also braking power, are also understood as drives within the meaning of the present patent application.

For rides having rail-borne vehicles, the typically quite large extension and the often not completely foreseeable track courses frequently result in the problem that the tracks must be secured in a particular way, in particular when more than one vehicle is using the track at the same time, or when a closed track course is present. One suitable means for securing such a track or track section is division into block segments which are suitably monitored. The latter means is preferably carried out completely automatically, for example by an appropriate controller which suitably evaluates, in a manner known per se, whether vehicles and/or other obstacles are present on the track and in the track section in question.

If an obstacle such as a stopped vehicle is now determined in a block segment, the vehicles which follow are not granted enabling for entry into this block segment. Therefore, the subsequent vehicles must at least be decelerated, or possibly brought to a standstill, prior to entry into this block segment. For this purpose, appropriate safety brakes are provided in the track course before the particular block segments. The safety brakes generally act mechanically on the vehicle, and are designed as block brakes, for example. However, these types of safety brakes have the disadvantage that they must be routinely serviced, and are relatively expensive.

SUMMARY OF THE INVENTION

The object of the present invention, therefore, is to provide a ride, a track section for a ride, and a method for operating a ride, in which the track section is divided into at least two block segments, and in which at least one vehicle may be safely decelerated in a first block segment if entry into a second block segment is not enabled, but in which this may be implemented in a more advantageous manner overall, while at the same time allowing increased appeal of the ride to be achieved.

The object is achieved by a track section according to the present invention, a method according thereto, and the ride according thereto. Advantageous refinements are described in the subclaims.

The present invention thus relates to a track section, having at least one track, for a ride having at least one rail-borne vehicle, the track section being divided into a first and a second block segment. The first block segment has a first hill segment having a first high point, and a second hill segment having a second high point, the first block segment ending at the second high point. The second block segment begins at the second high point, and has any arbitrary track course. In the first block segment, a first linear drive is situated before the first high point in the direction of travel, and a second linear drive is situated between the first high point and the second high point.

The present invention is characterized in particular in that the positions of the two high points relative to one another and the design of the linear drives with regard to their braking power are coordinated with one another in such a way that the vehicle can be brought to a standstill in the area of the first block segment if entry into the second block segment is not enabled. In this regard, of course, the position of the center of gravity of the overall vehicle is basically to be taken into account in the placement of the high points.

The invention is thus based on the finding that, by skillful positioning of the positions of the high points relative to one another and by the design of the linear drives with regard to their braking power and the selected course geometry in this section, the complete dissipation of the kinetic energy of the vehicle is made possible without having to mechanically act on the vehicle. The vehicle may thus be decelerated primarily via the course geometry, which is designed in a targeted manner, and optionally also by one or two linear drive(s), by engagement of the first drive at the latest prior to the first high point. This has the advantage that an additional safety brake is no longer necessary. This greatly reduces the costs for the track course, and also allows the braking effect of the linear drives to be integrated into the track elements to be produced or into the travel course in a targeted manner. This is because a variation of track elements may now be provided using the drive as well as the linear drives which act as brakes. Targeted pendulum motions may thus be produced in order to increase the variation for the passengers when traveling over the track section.

In one refinement, it is advantageous when the positions of the two high points relative to one another and the design of the at least one linear drive with regard to its braking power are coordinated with one another in such a way that the vehicle can be brought to a standstill in the area between the first and the second high point of the first block segment if entry into the second block segment is not enabled. It is thus ensured by the geometry of the track and the design of the braking power of the drive situated between the two high points that the vehicle is stopped in the valley region delimited by the hill segments, and no longer travels backward behind the first hill segment.

The positions of the two high points are advantageously coordinated with one another in such a way that the vehicle can be brought to a standstill in the area between the first and the second high point of the first block segment if entry into the second block segment is not enabled. In this refinement, the coordination is carried out only via the position of the high points. The braking power of the linear drive situated in between is no longer used in the design. Thus, in the simplest case this results in a course geometry in which the first high point is somewhat lower than the second high point. With particularly conservative dimensioning, the second high point is then higher only by an amount for which a backward-rolling vehicle no longer overcomes the first hill, ignoring the running resistances and assuming other forces, such as a maximum tailwind, which possibly have an accelerating effect. This has the advantage that when the vehicle is situated between the two high points and is not enabled for entry into the second block segment, it may safely be brought to a standstill, even without any braking intervention by the linear drive. This is because in the extreme case, the kinetic energy of the vehicle is dissipated solely due to the uphill travel on the hill segments and the friction losses which are always present.

In addition, it may be advantageous when the positions of the two high points relative to one another and the design of the linear drives with regard to their braking power are coordinated with one another in such a way that the vehicle can be brought to a standstill in the area before the first high point in the region of the first block segment if entry into the second block segment is not enabled. This means that when entry into the second block segment is not enabled, the vehicle undergoes a change in the direction of travel in the area of the second hill segment, and travels backwards in the direction of the first hill segment. As soon as the vehicle has overcome the first hill segment, it may be completely decelerated in the area of the first linear drive. It is of course conceivable that the vehicle is likewise decelerated (but also possibly accelerated) by the second linear drive when it travels past same, so that in any case it is reliably ensured that the vehicle is decelerated by the first linear drive.

Furthermore, the positions of the two high points and the braking effect of the second linear drive may be coordinated with one another in such a way that the vehicle is able to swing freely between the first and the second high point in order to dissipate its kinetic energy. In other words, the vehicle then swings between the first and the second hill segment. This has the advantage that, on the one hand, the vehicle dissipates kinetic energy due to the swinging, and on the other hand, the passengers are provided with enhanced appeal due to this ride feature, specifically, when the swinging may also be interrupted and/or repeated, for example in a targeted manner with the aid of the drive which is situated in this area.

In addition, it is advantageous when the positions of the two high points are coordinated with one another in such a way that the vehicle may swing freely between the first and the second high point in order to dissipate its kinetic energy. This means that, even in the event of a complete failure of the brakes, the vehicle swings until it comes to a complete standstill without a braking intervention by the second linear drive. This also has an entertaining effect on the passengers of the vehicle, since it results in multiple changes in direction, and with a very conservative design of the track section it is always ensured that the vehicle is not able to inadvertently travel into the second block segment.

It is advantageous when the drive power of the second linear drive is coordinated with the position of the second high point in such a way that the second linear drive accelerates a vehicle from a standstill in such a way that the vehicle is able to travel into the second block segment by overcoming the second high point. In this regard, it must be ensured that the vehicle has engagement with the drive area. This may be carried out using suitable auxiliary drives or by arrangement of the linear drive up to the point of the deepest valley region. This has the advantage that when the vehicle has been brought to a standstill in the first block segment between the two hill segments or between the two high points, a chain drive or the like is not necessary in order to bring the vehicle over the second high point, for example if there is a time delay in enabling entry into the second block segment. In addition, this also makes it possible for a vehicle to travel out of the area between the two hill segments without additional recovery efforts, and to be able to incorporate a further increase in enjoyment into the overall ride program by targeted deceleration to a standstill.

The maximum height of the first high point is advantageously the same as that of the second high point. In principle, the appearance of the track element is less important. For example, the track element may be a "camel back" track element, a track element having at least one loop, or a zero-G roll, or the like, which on the one hand meets the safety requirements for lack of enabling for entry into the second block segment, and on the other hand means an attractive track element for the passengers of the vehicle.

With regard to the method, the object is achieved in that the method for traveling over a track section with a vehicle has the following method steps:

- Accelerating the vehicle by means of the first linear drive in order to overcome the first high point; and
- Accelerating the vehicle by activating the drive function of the second linear drive in order to overcome the second high point, and entering into the second block segment if the second block segment is enabled; or
- Producing a change in the direction of travel of the vehicle on the second hill segment by deactivating or maintaining deactivation of the drive mode of the second linear drive, for example if the second block segment is not enabled for entry.

This has the advantage that a decision to enable entry into the second block segment need be made only just before the vehicle passes the second linear drive, but a standstill of the vehicle can still be achieved. If the enabling does not take place, the second linear drive will not further accelerate the vehicle, so that the vehicle is not able to overcome the second high point, and reverses in the area of the second hill segment and completes the further movement opposite the direction of travel. In other words, if entry into the second block segment is not enabled, the vehicle will change its direction of travel due to the lack of an acceleration effect of the second linear drive and the force of gravity, and will "roll back" in the direction of the first hill segment. However, it is also conceivable that the second linear drive only slightly accelerates the vehicle, so that, although the second high point cannot be overcome, the entertainment of the passengers is increased.

It is advantageous that if entry into the second block segment is not enabled, after undergoing a change in the direction of travel on the second hill segment the vehicle is additionally decelerated to a standstill in the first block segment, at least by swinging between the two high points and/or by the first linear drive. Activation of the brakes is dispensed with in such a procedure.

Alternatively or additionally, if entry into the second block segment is not enabled, at least one of the two linear drives may be transferred into a braking mode in order to bring the vehicle to a standstill within the first block segment. This means that the vehicle is decelerated, optionally even to a standstill, by targeted braking intervention, which in fact, however, is only supplementary, by the linear drives, in the area of the first block segment in such a way that the vehicle may be easily re-accelerated, preferably from this position, as soon as entry into the second block segment is enabled.

The invention further relates to a ride having at least one vehicle and one track section, the ride having a control device which controls the travel course of the at least one vehicle, and a measuring device which is connected to the control device, the measuring device being a measuring device which evaluates the behavior of the passengers of the vehicle and/or of the spectators. This has the advantage that the passengers of the vehicle and/or the spectators may actively intervene in the travel course of the vehicle, for example, in that their behavior causes a targeted change in the travel characteristic of the vehicle, such as a deceleration, an acceleration, or a "passive" switching of the drives for swinging. This likewise markedly increases the appeal of the travel course.

It is particularly advantageous when the measuring device has a sound level meter, a light meter, a motion measuring device, or the like. With a sound level meter it is conceivable, for example, for the vehicle to not enter into the second block segment, but instead to undergo a pendulum motion between the first and the second high point when the passengers are particularly excited, as expressed by loud screams. For example, this may also be brought about by a ride conductor who is controlling the ride prompting, via a speaker, the passengers to scream particularly loudly so that a pendulum motion of the vehicle is initiated. Alternatively, it is conceivable for this to be brought about by waving the arms or by shaking the feet.

It is also conceivable for spectators located outside the vehicle or passengers of another vehicle to be able to have a direct effect on the track elements of the vehicle which is passing by, traveling ahead, or traveling behind, likewise by screaming loudly. It is also conceivable for spectators to "shoot" reflectors mounted on the vehicle with a light gun, for example, and for a reflected light beam to be registered by a light meter, so that the controller then denies enabling for entry into the second block segment, and the vehicle may be set into a pendulum motion between the first and the second high point, or decelerated, or alternatively, only then enabling the entry into the second block segment or accelerating the vehicle particularly strongly.

It is advantageous for the measuring device to be situated in the area of the track section, but outside the at least one vehicle. This has the advantage that the vehicles remain lightweight, but the behavior of the passengers and/or of the spectators on the travel course of the vehicle can still be measured and evaluated for acting on the travel course.

In one refinement, the measuring device is situated on the vehicle. This has the advantage that the behavior of the passengers may be continuously evaluated so that the travel course of the vehicle may be changed in a targeted manner.

Furthermore, it is advantageous when the control device is designed in such a way that it grants enabling for entry into the second block segment in an automated manner after safety enabling when the second block segment is freely passable and at least one measured value determined by the measuring device is present, and the measured value exceeds at least one limiting value stored beforehand in the control device. In other words, a check is initially made as to whether a hazardous situation is present in the subsequent block segment, and a check is then made as to whether the behavior of the passengers or spectators permits entry into the second block segment according to the predetermined criterion or criteria.

BRIEF DESCRIPTION OF THE DRAWINGS

The invention is explained in greater detail below with reference to one exemplary embodiment shown in greater detail in the drawings, which show the following in a schematic manner.

DETAILED DESCRIPTION OF THE DRAWINGS

Figure 1:
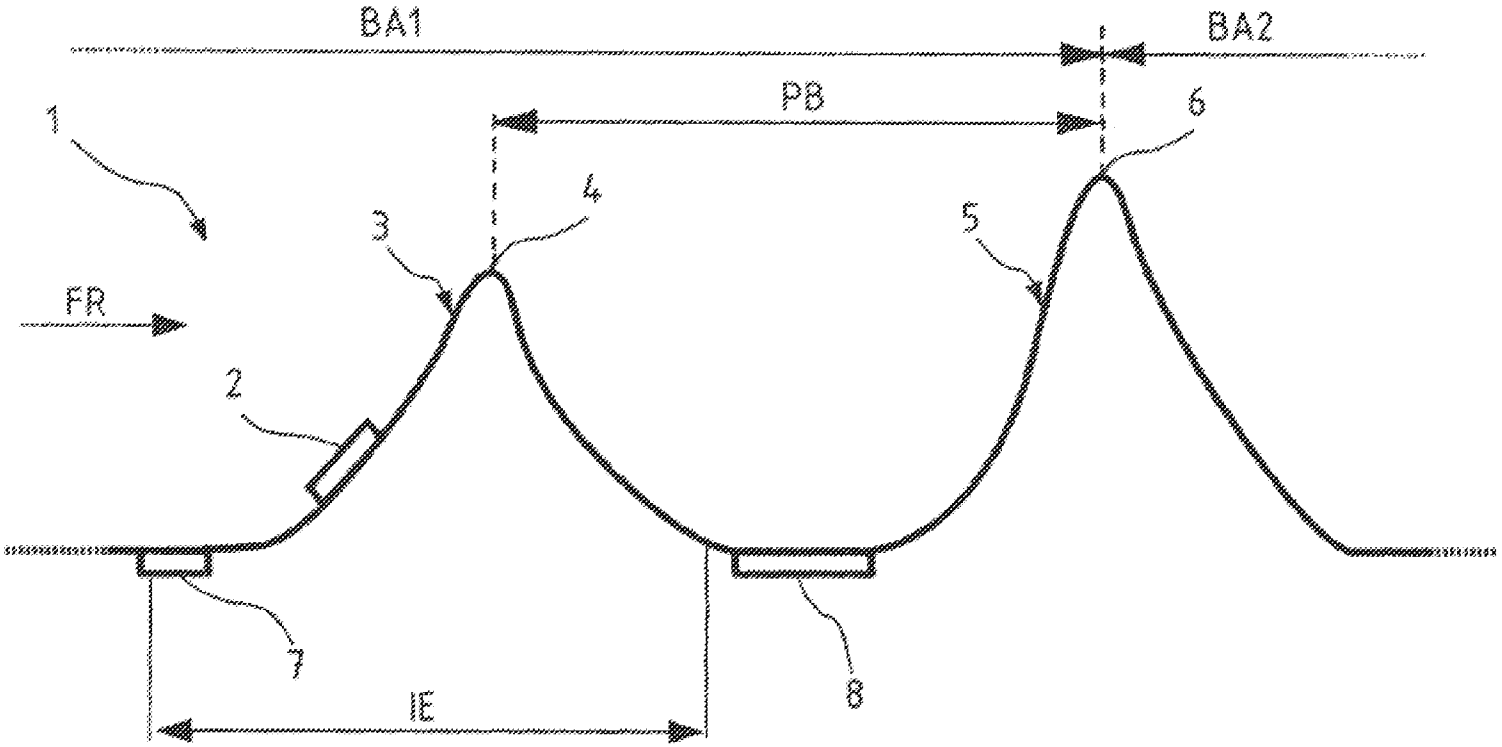
FIG. 1 shows a side view of a track section according to the invention.

FIG. 1 shows a track section 1 of a rail-borne ride having two hill segments 3, 5. Each of the hill segments 3, 5 is bell-shaped and has an absolute high point 4, 6, respectively. Thus, in this exemplary embodiment a so-called "camel back" is shown as the track element; other track elements, for example with a loop, are likewise possible. The track section 1 is divided into two block segments BA1, BA2, the first block segment ending at the second high point 5, and the second block segment BA2 beginning at the second high point. However, the block segments BA1 and BA2 may also overlap. The block segments BA1, BA2 are safety-relevant, in that entry of a vehicle 2 into a subsequent block segment is prevented if that block segment is blocked. This may be caused, for example, by a second vehicle 2, or also by objects or persons present on the track. In this exemplary embodiment, this means that the vehicle 2 cannot leave the first block segment BA1, and thus travel into the second block segment BA2, until enabling for entry into the second block segment BA2 has been granted.

In addition, the track section has two linear drives 7, 8 which are able to accelerate or decelerate the vehicle 2 which is present on the track, or also which have no effect on the vehicle 2 at all. In this exemplary embodiment, linear motors, in particular LSMs, are used as the linear drive, although it is also possible to use, for example, LIMs or friction wheels or the like. The braking effect of a linear motor is produced by a short circuit in the linear motor.

The first linear motor 7 is situated before the first hill segment 3, viewed in the direction of travel FR. The second linear motor 8 is situated between the first hill segment 3 and the second hill segment 5, viewed in the direction of travel FR, and is therefore situated between the first high point 4 and the second high point 5. The vehicle 2 may be accelerated by means of the first linear motor 7 in such a way that the kinetic energy is sufficient to overcome the first hill segment 3. For this purpose, it is sufficient for the vehicle 2 to be accelerated in such a way that it travels only just past the first high point 4.

The vehicle 2 may then be accelerated by means of the second linear motor 8 in such a way that the kinetic energy once again is just sufficient to overcome the second, higher hill segment 5 or the second high point 6 situated at a higher level, and thus to travel into the second block segment BA2. In this example, the differing power of the two drives 7 and 8 is indicated in the drawing by the different lengths of the drives.

A travel situation is now described below in which enabling for entry of the vehicle 2 into the second block segment BA2 is granted.

The vehicle 2 is accelerated at the first linear motor 7, viewed in the direction of travel FR, and begins to travel up the hill segment 3. The acceleration energy supplied to the vehicle 2 is selected in such a way that, for example, the vehicle 2 is almost at a standstill at the first high point 4 before the rapid descent from the first hill segment 3 takes place, the residual speed being sufficiently great at the high point 4.

The vehicle 2 is thus re-accelerated by the force of gravity and travels in the direction of the second hill segment 5. The vehicle 2 is further accelerated when it passes the second linear motor 8, so that the acceleration energy of the vehicle 2 is sufficient to overcome the second hill segment 5 in order to travel into the second block segment 2 [sic; BA2]. In this regard, for increasing the thrill factor for the passengers it may also be practical for the acceleration energy that is supplied to the vehicle 2 by the second linear motor 8 to be selected in such a way that the vehicle 2 almost comes to a standstill at the second high point 6 before a rapid descent likewise once again takes place. Here as well, however, the residual speed of the vehicle 2 naturally must not be too low.

If the vehicle 2 is not enabled for entry into the second block segment BA2, it must be brought to a standstill in the first block segment BA1. According to the invention, for this purpose there are various options, described below. All options share the common feature that a decision concerning enabling the second block segment BA2 is to be made no later than just before the vehicle 2 passes the second linear motor 8. The decision concerning enabling entry into the second block segment BA2 may thus be made within an interactive decision section IE. In addition, all options share the common feature that the travel course of the vehicle is achieved by targeted coordination of the positions of the high points 4, 6 and optionally also by taking the acceleration power and braking power of the linear motors 7, 8 into account.

The travel situation up to the point of passing the second linear motor 8 is thus identical to a travel situation in which entry into the second block segment BA2 has been enabled.

Option 1

The vehicle 2 is not accelerated, or is only slightly accelerated, when passing the second linear motor 8, so that the vehicle is not able to overcome the second hill segment 5. The vehicle 2 thus comes to a standstill on the second hill segment 5 before the second high point 6, viewed in the direction of travel FR, before it changes its direction of travel due to the force of gravity which acts on it, and travels backwards in the direction of the first high point 4.

When it now passes the second linear motor 8, the vehicle 2 may be either decelerated or accelerated, as necessary, at the second linear motor 8. In the latter case, this may take place in such a way that the vehicle overcomes the first hill segment 3, and after passing the first high point 4 travels backwards downhill in the direction of the first linear motor 7. When it passes the first linear motor 7, however, the vehicle 2 is now decelerated by same in such a way that the vehicle is still safely brought to a standstill within the first block segment BA1, which begins before the first linear motor 7.

If the second block segment BA2 is subsequently enabled for entry, the vehicle 2 is accelerated by the first linear motor 7 in such a way that it is able to overcome the first hill segment 3 and continue a normal travel situation as described above.

Option 2

The vehicle 2 is not accelerated, or is only slightly accelerated, when passing the second linear motor 8, so that it is not able to overcome the second hill segment 5. The vehicle 2 thus comes to a standstill on the second hill segment 5 before the second high point 6, viewed in the direction of travel FR, before it changes its direction of travel due to the force of gravity which acts on it, and is accelerated in the direction of the first high point 4.

When it now passes the second linear motor 8, the vehicle 2 may be either decelerated or accelerated, as necessary, at the second linear motor 8, so that it is not quite able to overcome the first hill segment 3 and briefly comes to a standstill behind the first high point 4 on the first hill segment 3, viewed in the normal direction of travel FR. The vehicle 2 subsequently changes its direction of travel once again, and is accelerated in the direction of the second linear motor 8 by the force of gravity. As soon as the vehicle 2 passes the second linear motor 8, it may be either decelerated to a standstill or re-accelerated, for example to initiate a pendulum motion of the vehicle 2 between the two high points 4, 6. In this case, the vehicle 2 swings back and forth in the pendulum area PB, and may possibly even be kept in this pendulum motion in the pendulum area PB by an appropriately metered acceleration action by the second linear motor 8.

Alternatively, for an appropriate position of the high points, the vehicle 2 may possibly not be accelerated or decelerated at all by the second linear motor 8, so that it freely completes a pendulum motion in the pendulum area PB between the two high points 4, 6 before it eventually comes to a standstill in the area of the second linear motor 8.

If the second block segment BA2 is subsequently enabled for entry, the vehicle 2 is accelerated from a standstill by the appropriately dimensioned second linear motor 8 in such a way that it is able to overcome the second hill segment 5 and continue a normal travel situation as described above.

Option 3

Option 3, of bringing the vehicle 2 to a standstill in the area of the first block segment BA1, essentially corresponds to option 2. In contrast to option 2, however, after the first change in the direction of travel on the second hill segment 5 and subsequently passing the second linear motor 8, the vehicle is decelerated to a complete standstill by the second linear motor 8.

If the second block segment BA2 is subsequently enabled for entry, the vehicle 2 is accelerated by the second linear motor 8 in such a way that it is able to overcome the second hill segment 5 and continue a normal travel situation as described above.

Option 4

As option 4, after it has overcome the first high point 4, the vehicle 2 may be completely decelerated by the second linear motor 8 when passing same, so that it comes to a standstill in the area of the second linear motor 8.

If the second block segment BA2 is subsequently enabled for entry, the vehicle 2 is accelerated by the second linear motor 8 in such a way that it is able to overcome the second hill segment 5 and continue a normal travel situation as described above.

Figure 2:
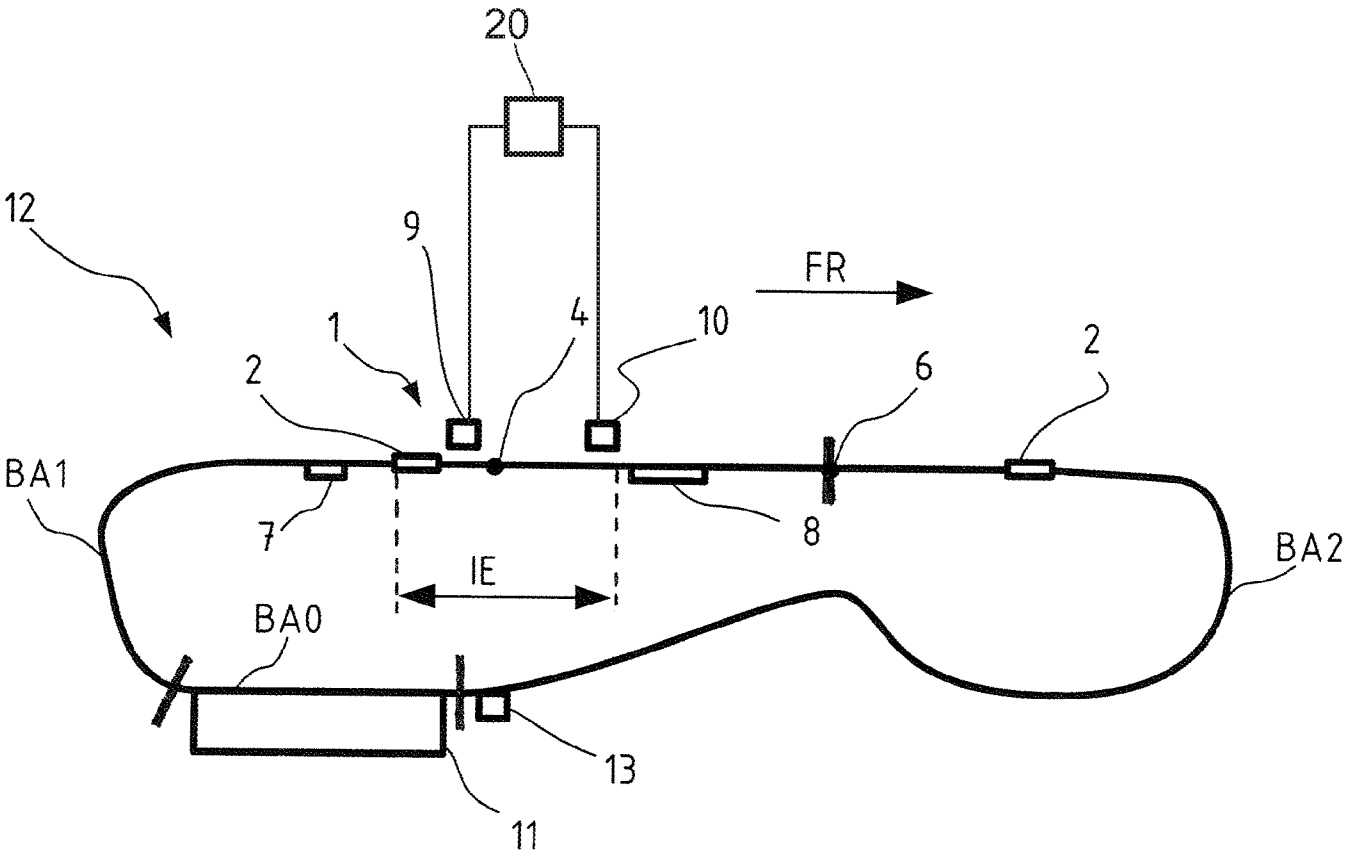
FIG. 2 shows a top view of a ride having a track section according to the invention.

FIG. 2 shows a top view of a ride 12, having a track section 1 according to the invention and a ride station 11 with a ride station brake 13. In this exemplary embodiment, the overall track is divided into three block segments BA0, BA1, and BA2. The block segment BA0 begins behind the ride station brake 13 and in front of the ride station 11, and ends just behind the ride station 11, viewed in the direction of travel FR. The first block segment BA1 also begins here, and ends at the second high point 6. The second block segment BA2 begins at the second high point 6 and ends between the ride station brake 13 and the ride station 11.

In addition, in this exemplary embodiment two vehicles 2 are present on the track. The ride 12 also has a measuring device. The measuring device is in operative connection with a control device 20 of the ride (not illustrated in greater detail). The control device monitors the travel situation of the vehicles 2, and grants enabling of the individual vehicles 2 for entry into the next block segment, provided that it is not blocked.

In the exemplary embodiment shown here, the measuring device is situated along the track and not on the vehicle 2 in order to keep the vehicles lightweight. Alternatively or additionally, however, the measuring device may be situated on the vehicle. The measuring device has a first measuring point 9 and a second measuring point 10. For example, the sound level of the passengers of the vehicle 2 may be measured at the first measuring point 9, which is situated at the first high point 4. When the passengers produce an appropriately high sound level, the measuring device may deliver a corresponding signal to the control device 20. The control device 20 then ensures that the vehicle 2 is not able to travel into the second block segment BA2, but instead undergoes a pendulum motion in the pendulum area PB.

In the present case, the second measuring point 10 is situated within the interactive decision section IE, just before the second linear motor 8, viewed in the direction of travel FR, and may likewise be a sound level meter. The sound level meter measures the sound level produced by the passengers of the vehicle 2. When the sound level is appropriately high, the measuring device may deliver a signal to the controller to maintain the vehicle 2 in a pendulum motion in the pendulum area PB.

The passengers of the vehicle 2 may thus actively influence the travel situation by their behavior, which greatly increases the enjoyment factor and entertainment, and thus the appeal, of the ride according to the invention.

Alternatively, it is conceivable for the sound level not to be measured, but instead, for some other behavior to be detected, such as movements of the passengers of the vehicle 2, for example waving motions of the arms.

It is also conceivable that the passengers of the vehicle 2 do not influence the travel situation by their behavior, but instead, that the behavior of spectators located outside the ride, such as movements or sound levels, etc., is detected in order to change the motion of the vehicle 2 in a targeted manner. Thus, the spectators may be equipped with light guns, for example, which are then "shot" onto appropriate reflectors on the vehicle 2. As soon as a spectator has hit a target, the travel situation of the vehicle 2 is changed; for example, it is decelerated and/or set into a pendulum motion in the pendulum area PB.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

LIST OF REFERENCE CHARACTERS

1 Track section
2 Vehicle
3 First hill segment
4 First high point
5 Second hill segment
6 Second high point
7 First linear drive
8 Second linear drive
9 First measuring point
10 Second measuring point
11 Ride station
12 Ride
13 Ride station brake
BA0 Block segment
BA1 First block segment
BA2 Second block segment
IE Interactive decision section
PB Pendulum area
FR Direction of travel

The invention claimed is:

1. A method for traveling over a track section with a vehicle, the method comprising:

accelerating the vehicle by means of a first linear drive in order to overcome a first high point;

accelerating the vehicle by activating a drive function of a second linear drive in order to overcome a second high point, and entering into a second block segment when the second block segment is enabled; and producing a change in the direction of travel of the vehicle on a second hill segment by deactivating or maintaining deactivation of the drive mode of the second linear drive if the second block segment is not enabled for entry;

wherein the track section comprises at least one track for a rail-borne ride which has at least one vehicle, wherein the track section is divided into a first block segment and the second block segment, the first block segment having a first hill segment with the first high point and the second hill segment with the second high point, and ending at the second high point, wherein the second block segment begins at the second high point and has any arbitrary track course, wherein the first block segment comprises the first linear drive situated before the first high point in the direction of travel, and the second linear drive situated between the first high point and the second high point, wherein the track section comprises a control device configured to control the travel course of the at least one vehicle and to enable the individual vehicles entry into the next block segment, provided that said next block segment is not blocked, wherein the positions of the first and second high points relative to one another and the design of the linear drives with regard to their braking power are coordinated with one another in such a way that the first and second linear drives are configured to bring the vehicle to a standstill in the first block segment if entry into the second block segment is not enabled by the control device.

2. The method according to claim 1, wherein the positions of the first and second high points relative to one another and the design of the linear drives with regard to their braking power are coordinated with one another in such a way that the vehicle is brought to a standstill in the area between the first and second high points of the first block segment if entry into the second block segment is not enabled.

3. The method according to claim 1, wherein the positions of the first and second high points are coordinated with one another in such a way that the vehicle is brought to a standstill in the area between the first and the second high points of the first block segment if entry into the second block segment is not enabled.

4. The method according to claim 1, wherein the positions of the first and second high points relative to one another and the design of the linear drives with regard to their braking power are coordinated with one another in such a way that the vehicle is brought to a standstill in the area before the first high point in the first block segment if entry into the second block segment is not enabled.

5. The method according to claim 1, wherein the positions of the first and second high points and the braking effect of the second linear drive are coordinated with one another in such a way that the vehicle is configured to swing between the first and the second high points in order to dissipate its kinetic energy.

6. The method according to claim 1, wherein the positions of the first and second high points are coordinated with one another in such a way that the vehicle is configured to swing freely between the first and the second high point in order to dissipate its kinetic energy.

7. The method according to claim 1, wherein the drive power of the second linear drive is coordinated with the position of the second high point in such a way that the second linear drive is configured to accelerate a vehicle from a standstill in such a way that the vehicle is able to travel into the second block segment by overcoming the second high point.

8. The method according to claim 1, wherein maximum height of the first high point is the same as maximum height of the second high point.

9. The method according to claim 1, wherein if entry into the second block segment is not enabled, after undergoing a change in the direction of travel on the second hill segment, decelerating the vehicle to a standstill in the first block segment by swinging the vehicle between the first and second high points or by the first linear drive.

10. The method according to claim 9, further comprising transferring at least one of the two linear drives into a braking mode, if entry into the second block segment is not enabled, to bring the vehicle to a standstill within the first block segment.

11. The method according to claim 1, wherein the ride further comprises a measuring device in operative connection with the control device, wherein the measuring device is configured to evaluate the behavior of one or more of the passengers of the vehicle and the spectators.

12. The method according to claim 11, wherein the measuring device has at least one of a sound level meter, a light meter, a motion measuring device, and a similar device.

13. The method according to claim 11 wherein the measuring device is situated in the area of the track section, but outside the at least one vehicle.

14. The method according to claim 11, wherein the measuring device is situated on the vehicle.

15. The method according to claim 11, wherein the control device is configured to enable entry into the second block segment in an automated manner after a safety query when the second block segment is freely passable and at least one measured value determined by the measuring device is present, and wherein the measured value exceeds at least one limiting value stored beforehand in the control device.

* * * * *